US012285794B2

(12) United States Patent
Park et al.

(10) Patent No.: US 12,285,794 B2
(45) Date of Patent: Apr. 29, 2025

(54) HOT STAMPING COMPONENT AND METHOD OF MANUFACTURING THE SAME

(71) Applicant: Hyundai Steel Company, Incheon (KR)

(72) Inventors: Jae Myoung Park, Incheon (KR); Je Youl Kong, Incheon (KR); Kye Jeong Park, Incheon (KR); Seung Chae Yoon, Incheon (KR)

(73) Assignee: Hyundai Steel Company, Incheon (KR)

( * ) Notice: Subject to any disclaimer, the term of this patent is extended or adjusted under 35 U.S.C. 154(b) by 246 days.

(21) Appl. No.: 18/076,967

(22) Filed: Dec. 7, 2022

(65) Prior Publication Data

US 2023/0150008 A1 May 18, 2023

Related U.S. Application Data

(63) Continuation of application No. PCT/KR2022/001412, filed on Jan. 26, 2022.

(30) Foreign Application Priority Data

Oct. 29, 2021 (KR) ..... 10-2021-0147069

(51) Int. Cl.
*C21D 9/46* (2006.01)
*B21D 22/02* (2006.01)
*B21D 37/16* (2006.01)

(52) U.S. Cl.
CPC ..... *B21D 37/16* (2013.01); *B21D 22/022* (2013.01); *C21D 9/46* (2013.01)

(58) Field of Classification Search
CPC ..... B21D 22/022; B21D 37/16; C21D 9/46; C21D 9/0062; C21D 9/573
See application file for complete search history.

(56) References Cited

U.S. PATENT DOCUMENTS

| | | | | |
|---|---|---|---|---|
| 9,631,248 | B2 * | 4/2017 | Hwang | C21D 8/0205 |
| 11,248,276 | B2 * | 2/2022 | Yi | C23C 2/40 |
| 11,326,227 | B2 | 5/2022 | Drillet et al. | |
| 11,583,909 | B2 * | 2/2023 | Kong | C22C 38/00 |
| 11,931,786 | B2 * | 3/2024 | Kong | C21D 8/005 |
| 2009/0242086 | A1 * | 10/2009 | Thomas | C21D 8/0205 148/654 |

(Continued)

FOREIGN PATENT DOCUMENTS

| | | | |
|---|---|---|---|
| JP | 2013-545890 | A | 12/2013 |
| KR | 2009-0086970 | A | 8/2009 |

(Continued)

OTHER PUBLICATIONS

CN 113290108A, Chen et al. Aug. 2021.*
Office Action issued Dec. 19, 2022 in Koream Application No. 10-2021-0147069.

*Primary Examiner* — Edward T Tolan
(74) *Attorney, Agent, or Firm* — Fox Rothschild LLP

(57) ABSTRACT

The present disclosure provides a method of manufacturing a hot stamping component, the method includes inserting a blank into a heating furnace, heating the blank, and transferring the heated blank from the heating furnace to a mold, wherein an air cooling time of the blank in the transferring of the blank satisfies Equation 1.

18 Claims, 8 Drawing Sheets

(56) References Cited

U.S. PATENT DOCUMENTS

| | | | |
|---|---|---|---|
| 2013/0192726 | A1 | 8/2013 | Chen et al. |
| 2021/0187577 | A1 | 6/2021 | Kong |
| 2022/0008978 | A1 | 1/2022 | Kim et al. |

FOREIGN PATENT DOCUMENTS

| | | | |
|---|---|---|---|
| KR | 102070579 | B1 | 1/2020 |
| KR | 2020-0080721 | A | 7/2020 |
| KR | 102240850 | B1 | 4/2021 |
| KR | 20210080166 | A | 6/2021 |
| KR | 10-2289525 | B1 | 8/2021 |
| KR | 102345608 | B1 | 12/2021 |

* cited by examiner

HOT STAMPING COMPONENT AND METHOD OF MANUFACTURING THE SAME

CROSS-REFERENCES TO RELATED APPLICATIONS

This Application is a continuation application of PCT/KR2022/001412 filed Jan. 26, 2022, which claims priority of Korean Patent Application 10-2021-0147069 filed on Oct. 29, 2021. The entire contents of these applications are incorporated herein by reference in their entirety.

TECHNICAL FIELD

The present disclosure relates to a hot stamping component and a method of manufacturing the same.

BACKGROUND

As environmental regulations and fuel economy regulations are tightened around the world, the need for lighter vehicle materials is increasing. Accordingly, research and development on ultra-high-strength steel and hot stamping steel have been actively conducted.

A hot stamping process generally includes heating/forming/cooling/trimming, and may utilize a phase transformation and microstructure change of a material during the process. In a hot stamping process, a heating process is a process of heating a blank in a heating furnace, and a cooling process is a process of cooling a hot-stamped molded body in a mold. In addition, the blank heated through the heating process may be exposed to room temperature and air-cooled while being inserted into the mold from the heating furnace.

As a related technology, Korean Patent Registration No. 10-2070579 (Title of the Invention: Hot Stamping Method) and the like have been disclosed.

SUMMARY

Technical Problem

Embodiments of the present disclosure may provide a method of improving the quality of components manufactured by hot stamping by controlling the heating time, air cooling time, and mold cooling time in consideration of various parameters, such as the material of a blank, the thickness of the blank, the heating temperature, etc.

Technical Solution

In an aspect of the present disclosure, provided is a method of manufacturing a hot stamping component, and the method includes inserting a blank into a heating furnace, heating the blank, and transferring the heated blank from the heating furnace to a mold, wherein an air cooling time of the blank in the transferring of the blank satisfies Equation 1 below.

$$\lambda_t=(a_t\times T_t+b_t)\times t^{c_t} \quad \text{<Equation 1>}$$

where $\lambda_t$ represents an air cooling time(s), $a_t$ represents a heating furnace discharge temperature and atmospheric temperature correction coefficient, $T_t$ represents a heating temperature (° C.), $b_t$ represents a material component correction coefficient, t represents a material thickness (mm), and $c_t$ represents a high temperature material thickness sensitivity correction coefficient.

In an exemplary embodiment, in Equation 1, at may be 0.0160 or greater and 0.0165 or less, $T_t$ may be Ac3 or greater and 1000° C. or less, $b_t$ may be −10 or greater and 0.5 or less, t may be 1 mm or greater and 2.6 mm or less, and $c_t$ may be 0.7 or greater and 0.9 or less.

In an exemplary embodiment, in Equation 1, $\lambda_t$ may be 5 s or more and 20 s or less.

In an exemplary embodiment, in the transferring of the blank, the heated blank may be air-cooled at room temperature.

In an exemplary embodiment, the heating of the blank may include step-heating the blank in multiple stages, and soaking the blank in a temperature range of about Ac3 to about 1000° C.

In an exemplary embodiment, in the heating of the blank, the heating time of the blank satisfies the following equation (2) below.

$$\lambda_n=(a_n\times T_n+b_n)\times t^{c_n} \quad \text{<Equation 2>}$$

where $\lambda_n$ represents a heating time(s), $a_n$ represents a heating furnace heat loss correction coefficient, $T_n$ represents a heating temperature (° C.), $b_n$ represents an Ac3 temperature correction coefficient, t represents a material thickness (mm), and $c_n$ represents a high temperature material thickness sensitivity coefficient.

In an exemplary embodiment, in Equation 2, an may be −0.60 or greater and −0.55 or less, $T_n$ may be Ac3 or greater and 1000° C. or less, $b_n$ may be 700 or greater and 900 or less, t may be 1 mm or greater and 2.6 mm or less, and $c_n$ may be 0.7 or greater and 0.9 or less.

In an exemplary embodiment, in Equation 2, An may be 100 s or more and 900 s or less.

In an exemplary embodiment, the heating furnace may include a plurality of sections having different temperature ranges.

In an exemplary embodiment, a ratio of a length of sections for step-heating the blank to a length of a section for soaking the blank is about 1:1 to 4:1.

In an exemplary embodiment, the method may further include, after transferring the blank, forming a molded body by pressing the transferred blank with the mold, and cooling the formed molded body.

In an exemplary embodiment, in the molding of the molded body, the molding start temperature of the blank may be 500° C. or greater and 700° C. or less.

In an exemplary embodiment, in the cooling of the molded body, a mold cooling time during which the molded body is cooled in the mold may satisfy Equation 3 below.

$$\lambda_q=(a_q\times P+b_q)\times t^{c_q} \quad \text{<Equation 3>}$$

where $\lambda_q$ represents a mold cooling time(s), $a_q$ represents a mold thermal conductivity correction coefficient, P represents a pressing force (MPa), $b_q$ represents a material hardenability correction coefficient, t represents a material thickness (mm), and $c_q$ represents a low temperature material thickness sensitivity coefficient.

In an exemplary embodiment, in Equation 3, $a_q$ may be −1.0 or greater and −0.2 or less, P may be 0.1 MPa or greater and 5 MPa or less, $b_q$ may be 11 or greater and 15 or less, t may be 1 mm or greater and 2.6 mm or less, and $c_q$ may be 1.00 or greater and 1.05 or less.

In an exemplary embodiment, in Equation 3, $\lambda_q$ may be 6 s or more and 40 s or less.

In an exemplary embodiment, in the cooling of the molded body, a cooling end temperature of the mold at which the cooling may be terminated is above room temperature and below about 200° C.

In an aspect of the present disclosure, provided is a hot stamping component having a tensile strength of 1350 MPa or greater and less than 2300 MPa.

Other aspects, features, and advantages other than those described above will become apparent from the following detailed description, claims and drawings for carrying out the present disclosure.

Advantageous Effects

According to an exemplary embodiment of the present disclosure as described above, it is possible to improve the quality of components manufactured by hot stamping by controlling the heating time, air cooling time, and mold cooling time in consideration of various parameters, such as the material of a blank, the thickness of the blank, and the heating temperature.

According to an exemplary embodiment of the present disclosure, a flexible process design is possible and quality control of manufactured hot stamping component may be facilitated by deriving a process window using a material thickness, heating time, air cooling time, and mold cooling time as parameters. Of course, the scope of the present disclosure is not limited by these effects.

DETAILED DESCRIPTION

Figure 1:
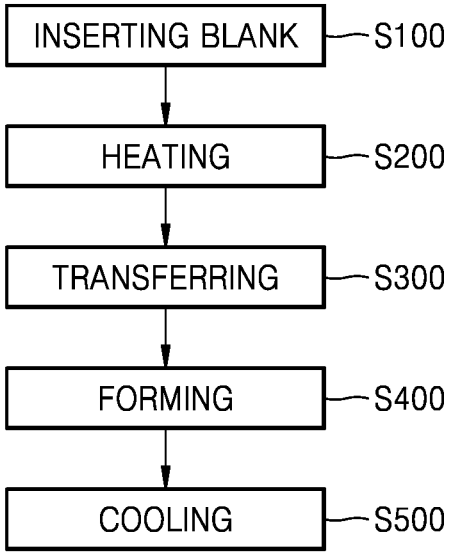
FIG. 1 shows a flowchart of a method of manufacturing a hot stamping component according to an exemplary embodiment of the present disclosure.

As the present disclosure allows for various changes and numerous embodiments, particular embodiments will be illustrated in the drawings and described in detail in the written description. The advantages, features, and methods of achieving the advantages of the present disclosure may be clear when referring to the embodiments described below together with the drawings. However, the present disclosure may have different forms and should not be construed as being limited to the descriptions set forth herein.

It will be understood that, although the terms "first", "second", "third", etc., may be used herein to describe various elements, these elements should not be limited by these terms. These terms are only used to distinguish one element from another.

In the following embodiments, the singular forms include the plural forms unless the context clearly indicates otherwise.

It will be further understood that the terms "comprises" and/or "comprising," when used in this specification, specify the presence of stated features or constituent elements but do not preclude the presence or addition of one or more other features or constituent elements.

It will be understood that when an element or layer is referred to as being "on" another element or layer, the element or layer may be directly on another element or layer or intervening elements or layers.

In the drawings, thicknesses of layers and regions may be exaggerated or reduced for convenience of explanation. For example, the sizes and thicknesses of elements in the drawings are arbitrarily expressed for convenience of explanation, and thus, the current inventive concept is not limited to the drawings.

In the present disclosure, as used herein, "A and/or B" refers to A, B, or A and B. Also, in the present disclosure, "at least one of A and B" represents the case of A, B, or A and B.

In the following embodiments, the meaning of a wiring "extending in a first direction or a second direction" includes not only extending linearly, but also extending in a zigzag or curved manner along the first or second directions.

In the following embodiments, when it is referred to as "on a plane", it means when a target component is viewed from above, and when it is referred to as "in cross-section", it means when a cross-section in which a target component is cut vertically is viewed from a side. In the following embodiments, the term "overlap" may mean overlapping "on a plane" or "on a cross-section".

Hereafter, the present disclosure will be described more fully with reference to the accompanying drawings. In describing the present disclosure with reference to drawings, like reference numerals are used for elements that are substantially identical or correspond to each other.

Figure 2:
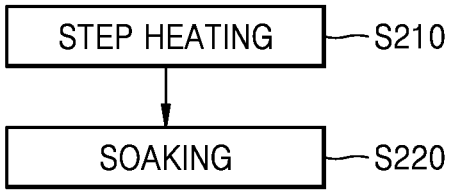
FIG. 2 shows a flowchart specifically illustrating a heating operation of a method of manufacturing a hot stamping component according to an exemplary embodiment of the present disclosure.

FIG. 1 shows a flowchart illustrating a method of manufacturing a hot stamping component according to an exemplary embodiment of the present disclosure, and FIG. 2 shows a flowchart illustrating a heating operation of the method of manufacturing a hot stamping component according to an exemplary embodiment. Hereinafter, the method of manufacturing a hot stamping component will be described with reference to FIGS. 1 and 2.

Referring to FIG. 1, the method of manufacturing a hot stamping component according to an embodiment may include inserting a blank (S100), a heating (S200), a transferring (S300), a forming (S400), and a cooling (S500).

First, the inserting a blank (S100) may be an operation of inserting a blank into a heating furnace having a plurality of sections having different temperature increase rate ranges. The blank may be provided in a form in which a plating layer is formed on at least one surface of a base material. The base material may be a base steel sheet manufactured by performing a hot rolling process and/or a cold rolling process on a steel slab cast to include a predetermined alloying element in a predetermined content as a base steel sheet.

In an exemplary embodiment, the base steel sheet may include carbon (C), silicon (Si), manganese (Mn), phosphorus (P), sulfur(S), a balance iron (Fe), and other unavoidable impurities. For example, the base steel sheet may include carbon (C) in an amount of 0.01 wt % or greater and 0.5 wt % or less, silicon (Si) in an amount of 0.01 wt % or greater to 1.00 wt % or less, manganese (Mn) in an amount of 0.3 wt % or greater to 2.0 wt % or less, phosphorus (P) in an amount greater than 0 and 0.1 wt % or less, sulfur(S) in an amount greater than 0 and 0.1 wt % or less, and a balance of iron (Fe) and other unavoidable impurities.

In addition, the base steel sheet may further include one or more selected from the group consisting of boron (B), titanium (Ti), niobium (Nb), chromium (Cr), molybdenum (Mo), and nickel (Ni). For example, the base steel sheet may further include at least one of boron (B) in an amount of 0.0001 wt % or greater and 0.005 wt % or less, titanium (Ti) in an amount of 0.01 wt % or greater and 0.1 wt % or less, niobium (Nb) in an amount of 0.01 wt % or greater and 0.1 wt % or less, chromium (Cr) in an amount of 0.01 wt % % or greater and 0.5 wt % or less, molybdenum (Mo) in an amount of 0.01 wt % or greater and 0.5 wt % or less, nickel (Ni) in an amount of 0.01 wt % or greater and 1.0 wt % or less.

In an exemplary embodiment, because the hot stamping component is manufactured using a blank, the manufactured hot stamping component may also include the above-described components described above.

Carbon (C) is a major element that determines strength and hardness of steel, and after a hot stamping (or hot pressing) process, it may be added for the purpose of securing tensile strength of a steel. In addition, carbon may be added for the purpose of securing hardenability property of a steel material. In an exemplary embodiment, carbon (C) may be included in an amount of 0.01 wt % or greater and 0.5 wt % or less with respect to the total weight of the base steel sheet. When carbon is included in an amount of less than 0.01% by weight based on the total weight of the base steel sheet, it may be difficult to achieve the mechanical strength of the present disclosure. On the other hand, when carbon is included in an amount exceeding 0.5% by weight based on the total weight of the base steel sheet, a problem of lowering the toughness of the steel or a problem of controlling the brittleness of the steel may be caused.

Silicon (Si) may act as a ferrite stabilizing element in the base steel sheet. Silicon (Si) improves ductility by cleaning ferrite, and suppresses the formation of carbides in a low-temperature region, thereby improving the carbon concentration in austenite. Furthermore, silicon may be a key element in hot rolling, cold rolling, hot stamping, homogenization of tissue (pearlite, manganese segregation zone control), and fine dispersion of ferrite. In an exemplary embodiment, silicon may be included in an amount of 0.01 wt % or greater and 1.0 wt % or less with respect to the total weight of the base steel sheet. When silicon is included in an amount less than 0.01 wt % with respect to the total weight of the base steel sheet, the function described above may not be sufficiently exhibited. On the other hand, when silicon is included in an amount exceeding 1.0 wt % with respect to the total weight of the base steel sheet, the loads of hot-rolling and cold-rolling may increase, hot-rolled red scale becomes excessive, and bondability may be deteriorated.

Manganese (Mn) may be added for the purpose of increasing hardenability and strength during heat treatment. In an exemplary embodiment, manganese may be included in an amount of 0.3% or greater and 2.0% or less by eight based on the total weight of the base steel sheet. When manganese is included in an amount of less than 0.3 wt % based on the total weight of the base steel sheet, it is highly likely that the material after hot stamping is under-hardenable due to insufficient hardenability (insufficient a hard phase fraction). On the other hand, when manganese is included in an amount exceeding 2.0 wt % based on the total weight of the base steel sheet, ductility and toughness due to manganese segregation or pearlite band may be reduced, and it may cause deterioration of bending performance and a heterogeneous microstructure.

Phosphorus (P) is an element that segregates well and inhibits the toughness of steel. In an exemplary embodiment, phosphorus (P) may be included in an amount greater than 0 and 0.1% by weight or less based on the total weight of the base steel sheet. When phosphorus is included in the range described above with respect to the total weight of the base steel sheet, the deterioration of the toughness of the steel may be prevented. On the other hand, when phosphorus is included in an amount exceeding 0.1 wt % based on the total weight of the base steel sheet, cracks may be caused during processing, and an iron phosphide compound may be formed, thereby reducing the toughness of the steel.

Sulfur(S) may be an element that inhibits processability and physical properties. In an exemplary embodiment, sulfur may be included in an amount greater than 0 and 0.1 wt % or less based on the total weight of the base steel sheet. When sulfur is included in an amount exceeding 0.1% by weight based on the total weight of the base steel sheet, hot workability may be deteriorated, and surface defects, such as cracks may occur due to the generation of large inclusions.

Boron (B) is added for the purpose of securing hardenability and strength of steel by securing a martensite structure, and may provide a grain refining effect by increasing an austenite grain growth temperature. In an exemplary embodiment, boron may be included in an amount of 0.0001 wt % or greater and 0.005 wt % or less with respect to the total weight of the base steel sheet. When boron is included in the range described above with respect to the total weight of the base steel sheet, it is possible to prevent the occurrence of hard phase brittleness and secure high toughness and bendability.

Titanium (Ti) may be added for the purpose of strengthening hardenability by forming precipitates and material improvement after hot stamping heat treatment. In addition, titanium forms a precipitation phase, such as Ti(C,N) at a high temperature, thereby effectively contributing to austenite grain refinement. In an exemplary embodiment, titanium may be included in an amount of 0.01 wt % or greater and 0.1 wt % or less with respect to the total weight of the base steel sheet. When titanium is included in the range described above with respect to the total weight of the base steel sheet, continuous casting defects may be prevented, coarsening of precipitates may be prevented, the physical properties of the steel may be easily secured, and the occurrence of cracks on a surface of the steel may be prevented or minimized.

Niobium (Nb) may be added for the purpose of increasing strength and toughness according to a decrease in a martensite packet size. In an exemplary embodiment, niobium (Nb) may be included in an amount of 0.01 wt % or greater and 0.1 wt % or less with respect to the total weight of the base steel sheet. When niobium (Nb) is included in the range described above with respect to the total weight of the base steel sheet, a crystal grain refinement effect of the steel material is excellent in a hot rolling and cold rolling process, the occurrence of cracks in the slab and the occurrence of brittle fracture of a product during steel making/continuous casting are prevented, and the generation of steelmaking coarse precipitates is minimized.

Chromium (Cr) may be added for the purpose of improving hardenability and strength of steel. In an exemplary embodiment, chromium may be included in an amount of 0.01 wt % or greater and 0.5 wt % or less based on the total weight of the base steel sheet. When chromium is included in the range described above with respect to the total weight of the base steel sheet, it is possible to improve the hardenability and strength of steel, and to prevent an increase in production cost and a decrease in the toughness of the steel.

Molybdenum (Mo) may contribute to strength improvement by suppressing coarsening of precipitates during hot rolling and hot stamping and increasing hardenability. Molybdenum (Mo) may be included in an amount of 0.01 wt % or greater and 0.5 wt % or less based on the total weight of the base steel sheet. When molybdenum is included in the range described above with respect to the total weight of the base steel sheet, the effect of suppressing coarsening of precipitates during hot rolling and hot stamping and hardenability may be increased.

Nickel (Ni) may be added for the purpose of securing hardenability and strength. In addition, nickel is an austenite stabilizing element and may contribute to improvement of elongation by controlling austenite transformation. In an exemplary embodiment, nickel may be included in in an amount of 0.01 wt % or greater and 1.0 wt % or less based on the total weight of the base steel sheet. When nickel is included in less than 0.01% by weight based on the total weight of the base steel sheet, effect described above may not be properly implemented. When nickel is included in an amount exceeding 1.0 wt % based on the total weight of the base steel sheet, toughness may be reduced, cold workability may be reduced, and manufacturing cost of the product may increase.

In an exemplary embodiment, in the operation of inserting a blank (S100), the blank inserted into the heating furnace may be mounted on a roller and then transferred along a transfer direction.

Referring to FIGS. 1 and 2, after the inserting a blank (S100), an operation of heating (S200) may be performed. In an exemplary embodiment, the heating (S200) may include a step-heating (S210) and a soaking (S220). Therefore, after inserting the blank (S100), the step-heating (S210) and the soaking (S220) may be performed. The step-heating (S210) and the soaking (S220) may be an operation in which the blank passes through a plurality of sections provided in the heating furnace and is heated.

In an exemplary embodiment, a total temperature of the heating furnace may be in a range from about 680° C. to about 1000° C. Specifically, the entire temperature of the heating furnace in which the step-heating (S210) and the soaking (S220) are performed may be in a range from about 680° C. to about 1000° C. In this case, the temperature of the heating furnace in which the step-heating (S210) is performed may be 680° C. to Ac3, and the temperature of the furnace in which the soaking (S220) is performed may be Ac3 to 1000° C.

In the step-heating (S210), the blank may be heated in multiple stages while passing through a plurality of sections provided in the heating furnace. Among the plurality of sections provided in the heating furnace, there are a plurality of sections in which the step-heating (S210) is performed, and the temperature may be set for each section so as to increase in a direction from an inlet of the heating furnace into which the blank is inserted to an outlet of the heating furnace from which the blank is discharged, and thus, the temperature of the blank may be increased in stages.

A soaking (S220) may be performed after the step-heating (S210). In the soaking (S220), the step-heated (stepwise heated or step heated) blank may be heat treated while passing through the section of the heating furnace set at a temperature of Ac3 to 1000° C. Preferably, in the soaking (S220), the step-heated blank may be soaked at a temperature in a range from about 830° C. to about 1,000° C. In addition, there may be at least one section in which the soaking (S220) is performed among a plurality of sections provided in the heating furnace.

Figure 3:
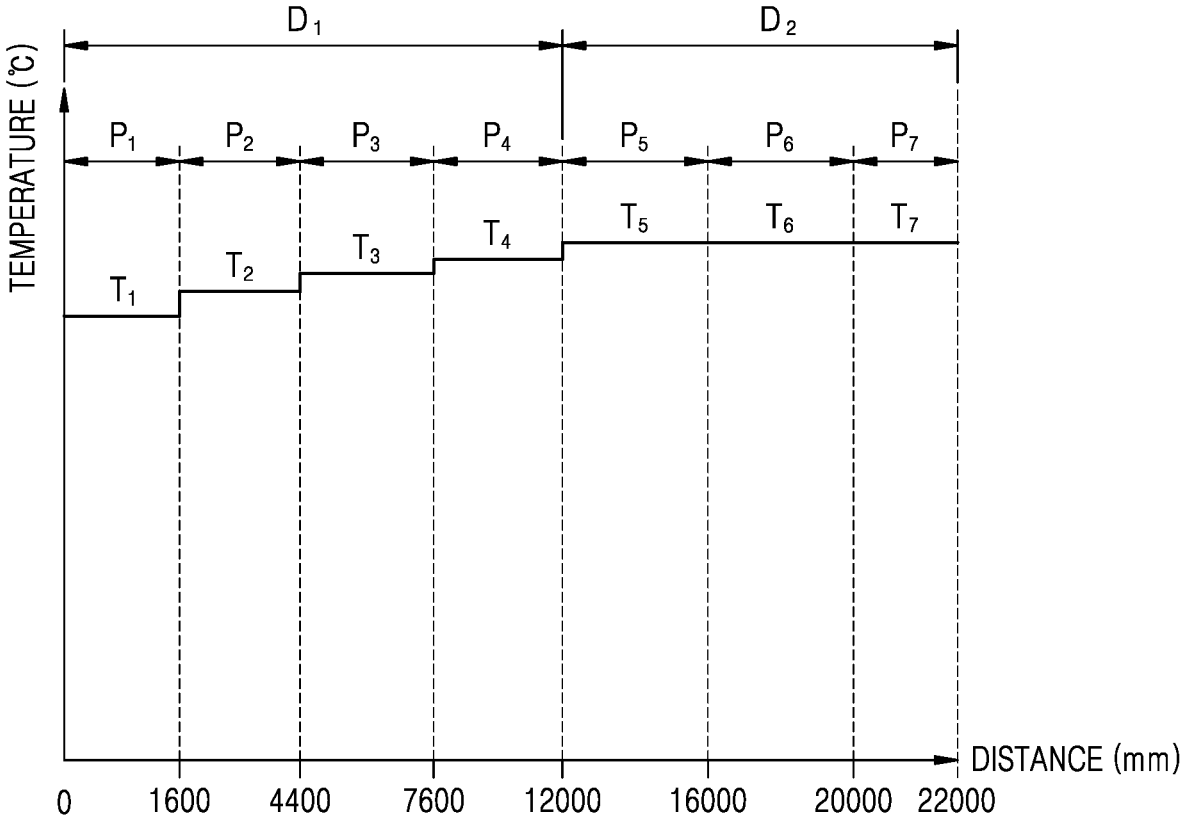
FIG. 3 shows a diagram for explaining a heating furnace having a plurality of sections in a heating operation of a method of manufacturing a hot stamping component according to an exemplary embodiment of the present disclosure.

FIG. 3 shows a diagram for explaining a heating furnace having a plurality of sections in a heating operation of a method of manufacturing a hot stamping component according to an embodiment of the present disclosure.

Referring to FIG. 3, the heating furnace according to an embodiment may include a plurality of sections having different temperature ranges from each other. More specifically, the heating furnace may include a first section $P_1$ having a first temperature range $T_1$, a second section $P_2$ having a second temperature range $T_2$, a third section $P_3$ having a third temperature range $T_3$, a fourth section $P_4$ having a fourth temperature range $T_4$, a fifth section $P_5$ having a fifth temperature range $T_5$, a sixth section $P_6$ having a sixth temperature range $T_6$, and a seventh section $P_7$ having a seventh temperature range $T_7$.

In an exemplary embodiment, in the step-heating (S210), the blank may be heated by stages while passing through the first section $P_1$ to the fourth section $P_4$ defined in the heating furnace. In addition, in the soaking (S220), the blank that is step-heated in the first section $P_1$ to the fourth section $P_4$ may be soaked while passing through the fifth section $P_5$ to the seventh section $P_7$.

The first section $P_1$ to the seventh section $P_7$ may be sequentially disposed in the heating furnace. The first section $P_1$ having the first temperature range $T_1$ is adjacent to an inlet of the heating furnace into which the blank is inserted, and the seventh section $P_7$ having the seventh temperature range $T_7$ may be adjacent to the outlet of the heating furnace from which the blank is discharged. Accordingly, the first section $P_1$ having the first temperature range $T_1$ may be the first section of the heating furnace, and the seventh section $P_7$ having the seventh temperature range $T_7$ may be the last section of the heating furnace. Among the plurality of sections of the heating furnace, the fifth section $P_5$, the sixth section $P_6$, and the seventh section $P_7$ may be sections in which soaking is performed, not sections in which step-heating is performed.

The temperature of a plurality of sections provided in the heating furnace, for example, the temperature of the first section $P_1$ to the seventh section $P_7$ may increase in a direction from the inlet of the heating furnace through which the blank is inserted to the outlet of the heating furnace from which the blank is discharged. However, the temperatures of the fifth section $P_5$, the sixth section $P_6$, and the seventh section $P_7$ may be the same. In addition, a temperature difference between two adjacent sections among a plurality of sections provided in the heating furnace may be greater than 0° C. and less than or equal to 100° C. For example, the temperature difference between the first section $P_1$ and the second section $P_2$ may be greater than 0° C. and less than or equal to 100° C.

In an exemplary embodiment, the first temperature range $T_1$ of the first section $P_1$ may be in a range from about 680° C. to about 870° C. The second temperature range $T_2$ of the second section $P_2$ may be in a range from about 700° C. to about 900° C. The third temperature range $T_3$ of the third section $P_3$ may be in a range from about 750° C. to about 930° C. The fourth temperature range $T_4$ of the fourth section $P_4$ may be in a range from about 800° C. to about 950° C. The fifth temperature range $T_5$ of the fifth section $P_5$ may be in a range from about Ac3 to about 1000° C. Preferably, the fifth temperature range $T_5$ of the fifth section $P_5$ may be 830° C. or higher and 1,000° C. or less. The sixth temperature range $T_6$ of the sixth section $P_6$ and the seventh temperature range $T_7$ of the seventh section $P_7$ may be the same as the fifth temperature range $T_5$ of the fifth section $P_5$.

In FIG. 3, the heating furnace according to an embodiment is illustrated as having seven sections having different temperature ranges from each other, but the present invention is not limited thereto. Five, six, or eight sections having different temperature ranges may be provided in the heating furnace.

In an exemplary embodiment, in the step-heating (S210), the blank is step-heated in multiple stages while passing through a plurality of sections (e.g., the first section $P_1$ to the fourth section $P_4$) defined in the heating furnace.

A soaking (S220) may be performed after the step-heating (S210). The soaking (S220) may be performed in the last part of the plurality of sections of the heating furnace. In an exemplary embodiment, the soaking (S220) may be performed in the fifth section $P_5$, the sixth section $P_6$, and the seventh section $P_7$ of the heating furnace. When a plurality of sections are provided in the heating furnace, if a length of one section is long, there may be problems, such as temperature change in the section. Therefore, the sections in which the soaking (S220) is performed are divided into the fifth section $P_5$, the sixth section $P_6$, and the seventh section $P_7$, but the fifth section $P_5$, the sixth section $P_6$, and the seventh section $P_7$ may have the same temperature range in the heating furnace.

In the soaking (S220), the step-heated blank may be soaked at a temperature in a range from about Ac3 to about 1,000° C. Preferably, in the soaking (S220), the step-heated blank may be soaked at a temperature of 830° C. to 1,000° C.

In an exemplary embodiment, because the heating (S200) is provided with the step-heating (S210) and the soaking (S220), it is possible to set the temperature of the heating furnace in stages, thereby improving the energy efficiency of the heating furnace.

In an exemplary embodiment, the heating furnace may have a length of about 20 m to about 40 m along a transport path of the blank. The heating furnace may have a plurality of sections having different temperature ranges, and a ratio of a length $D_1$ of the section in which the blank is step-heated among the plurality of sections to a length $D_2$ of the section in which the blank is soaked among the plurality of sections may satisfy 1:1 to 4:1. When the ratio of the length $D_1$ of the section in which the blank is step-heated to the length $D_2$ of the section in which the blank is soaked exceeds 1:1 due to the increase in the length of the section in which the blank is soaked in the heating furnace, in the soaking section, an amount of hydrogen permeation into the blank increases, thereby increasing a delayed fracture. On the other hand, when the ratio of the length $D_1$ of the section in which the blank is step-heated to the length $D_2$ of the section in which the blank is soaked is less than 4:1 due to the length of the section in which the blank is soaked is reduced, a soaking section (time) is not sufficiently secured, and thus, the strength of a hot stamping component manufactured by the manufacturing process of the hot stamping component may be non-uniform.

In an exemplary embodiment, the length of the uniform heating section among the plurality of sections provided in the heating furnace may be in a range from about 20% to about 50% of the total length of the heating furnace.

Referring to FIG. 1, after the heating (S200), the transferring (S300), the forming (S400), and the cooling (S500) may further be performed.

In an exemplary embodiment, the transferring (S300) may be an operation of transferring the heated blank from the heating furnace to a mold. In this case, in the transferring (S300), the heated blank may be cooled at ambient temperature (or room temperature) while being transferred to the mold. The heated blank may be air cooled during transport. If the heated blank is not cooled by air, a mold entry temperature (e.g., a molding start temperature) may increase, and thus, wrinkles (or curvatures) may occur on a surface of a manufactured hot stamping component. In addition, it may be preferable to air-cool the heated blank during transport because the use of the refrigerant may affect a subsequent process (hot stamping).

In an exemplary embodiment, the forming (S400) may be an operation of forming a molded body by hot stamping the transferred blank. Specifically, in the forming (S400), the molded body may be formed by pressing the blank with a mold.

In an exemplary embodiment, the cooling (S500) may be an operation of cooling the molded body. In the cooling (S500), the blank may be cooled in a pressurized mold.

Figure 4:
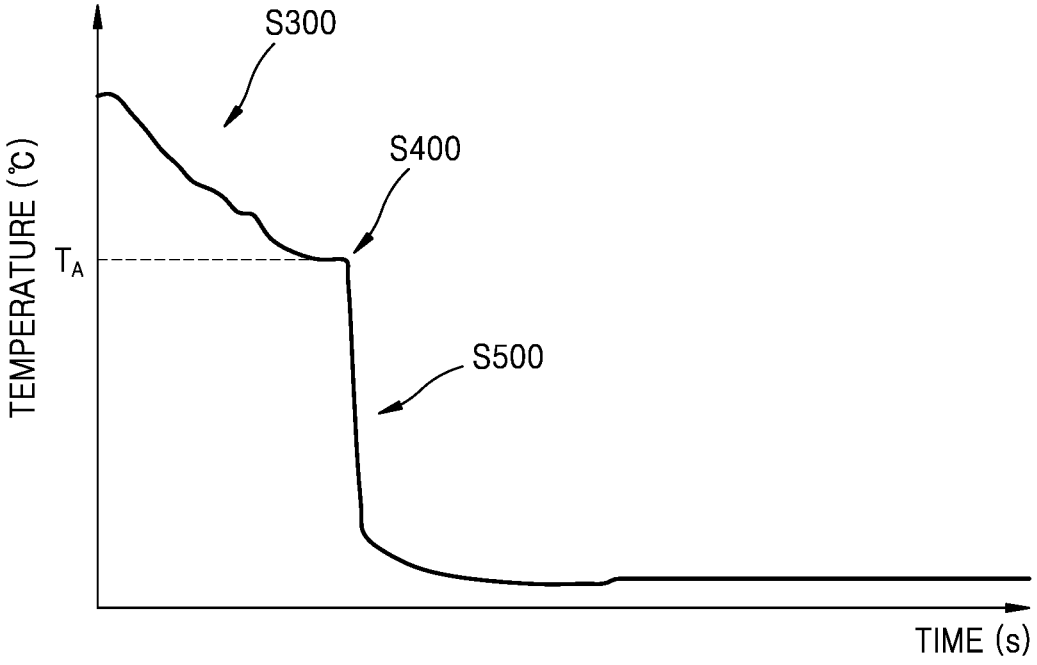
FIG. 4 shows a graph showing a behavior of a heated blank that is cooled in time.

FIG. 4 shows a graph showing a cooling behavior of the heated blank according to time. Specifically, FIG. 4 is a graph showing a cooling behavior of the heated blank during the operations of the transferring (S300), the forming (S400), and the cooling (S500) after the blank heated through the heating (S200) is taken out from the heating furnace.

Referring to FIG. 4, after the blank heated through the heating S200 is taken out from the heating furnace, the heated blank may be cooled while passing through the operations of the transferring S300, the forming S400, and the cooling S500.

In an exemplary embodiment, the heated blank may be cooled at ambient temperature (or room temperature) in the operation of the transferring (S300). Specifically, in the transferring (S300), after the blank heated through the heating (S200) is taken out from the heating furnace, it may be cooled at ambient temperature (or room temperature) while being transferred to a mold.

Then, in the forming (S400), the forming of the blank cooled at ambient temperature (or room temperature) may be started. At this time, the temperature at which a molding of the blank starts may be referred to as a molding start temperature TA. That is, in the transferring (S300), the blank heated through the heating (S200) may be cooled (or air cooled) from the atmospheric temperature (or room temperature) to the molding start temperature TA after being taken out from the heating furnace.

In an exemplary embodiment, the molding start temperature TA may be 500° C. or higher and 700° C. or less. When the molding start temperature TA is less than 500° C., the molding initiation temperature TA may be too low to deteriorate the formability of the blank, and the manufactured hot stamping component may not have a target structure and physical properties. On the other hand, when the molding start temperature TA is higher than 700° C., wrinkles (or curvatures) may occur on a surface of the manufactured hot stamping component. In addition, a plating layer of the blank may be sintered in a mold. Therefore, when the molding start temperature TA is 500° C. or higher and 700° C. or less, the formability of the blank may be improved, the manufactured hot stamping component may have a target structure and physical properties, and the occurrence of wrinkles (or curvatures) on a surface of the manufactured hot stamping component may be prevented or minimized.

Afterwards, in an exemplary embodiment, in the forming (S400), a molded body may be formed by molding the blank transferred to the mold through the transferring (S300), and the molded body may be cooled in the cooling (S500). At this time, the cooling (S500) of the molded body may be performed in the mold.

Specifically, the final product may be formed by cooling the molded body at the same time as molding into the final component shape in the mold. The mold may be provided with a cooling channel through which a refrigerant circulates therein. It is possible to rapidly cool the molded body by circulating a refrigerant supplied through the cooling channel provided in the mold. At this time, in order to prevent a spring back phenomenon of a sheet material and to maintain a desired shape, rapid cooling may be performed while pressing the mold in a closed state. In the molding and cooling operation of the molded body, the molded body may be cooled with an average cooling rate of at least 10° C./s or greater to the martensite end temperature.

In an exemplary embodiment, the cooling end temperature of the mold at which the cooling (S500) is terminated may be about room temperature or higher and about 200° C. or less. If the mold cooling end temperature is less than room temperature, the productivity of the manufacturing process may be reduced. On the other hand, when the mold cooling end temperature is higher than 200° C., the manufactured hot stamping component is air cooled at room temperature. At this time, distortion may occur in the hot stamping component, and thus, it may be difficult to secure a target material. Therefore, when the cooling end temperature of the mold at which the cooling S500 ends satisfies a range from room temperature or higher to about 200° C. or less, the productivity of the manufacturing process may be improved, and because the manufactured hot stamping component is air cooled at room temperature, the occurrence of warpage in the hot stamping component may be prevented or minimized.

Figure 5:
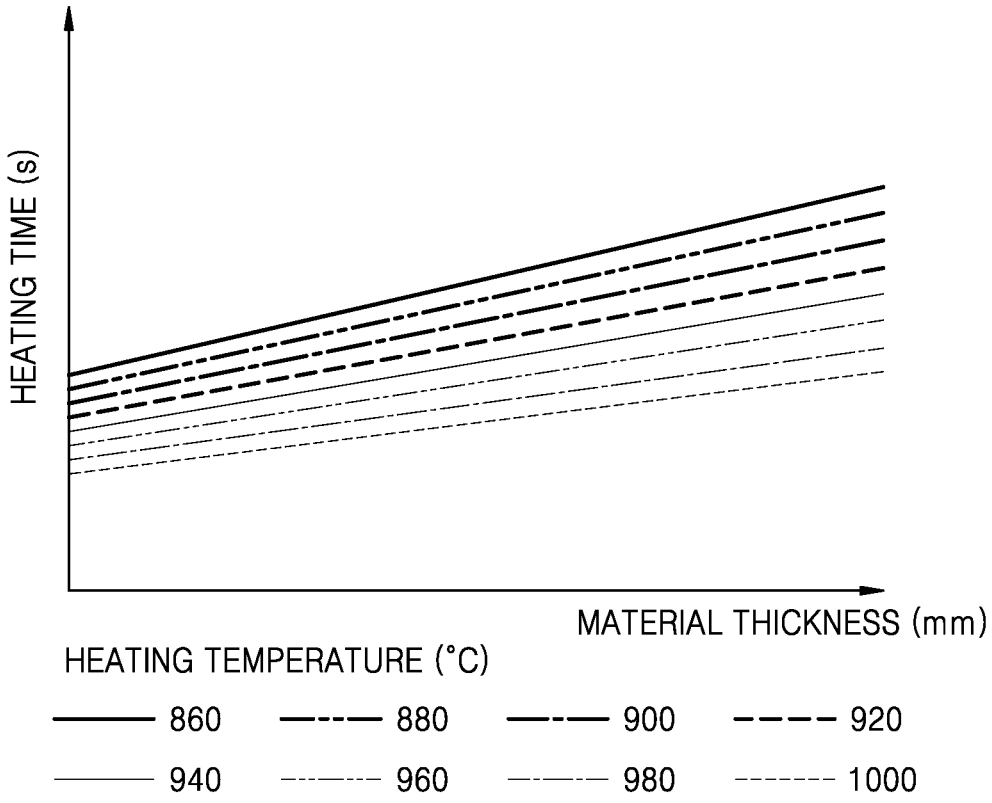
FIG. 5 shows a graph illustrating a heating time according to a material thickness and a heating time according to a heating temperature.

FIG. 5 shows a graph illustrating a heating time according to a material thickness and a heating time according to a heating temperature. Specifically, FIG. 5 is a graph illustrating a minimum heating time according to a thickness of a material and a minimum heating time according to a heating temperature. In FIG. 5, the heating temperature denotes a soaking temperature of the soaking (S220), and the heating time denotes a total heating time of the heating (S200).

Referring to FIGS. 1, 2, and 5, when the material thickness is the same, it may be seen that the minimum heating time increases as the heating temperature decreases. In addition, when the heating temperature is the same, it may be seen that the minimum heating time increases as the thickness of the material increases.

If the heating time (e.g., the total heating time) during which the blank is heated in the heating S200 is short, sufficient phase transformation may not be achieved in the blank. On the other hand, if the heating time during which the blank is heated in the heating S200 is excessive, austenite grain coarsening and hydrogen embrittlement resistance may occur, as well as the thickness of a plating layer may be increased, thereby reducing weldability. Therefore, it is necessary to adjust the heating time in the heating (S200). However, in order to control the heating time in the heating (S200), it is required to consider not only the heating temperature and the thickness of the blank (e.g., the thickness of the material), but also various variables, such as heat loss of the heating furnace caused by the sealing degree of the heating furnace, atmosphere, heat source, etc. and the composition of the blank.

Accordingly, the present inventors derived Equation 1 capable of easily controlling the heating time through sufficiently repeated experiments. In an exemplary embodiment, the heating time of the blank in the heating (S200) may satisfy Equation 1 below.

$$\lambda_n=(a_n\times T_n+b_n)\times t^{c_n} \quad \text{<Equation 1>}$$

In Equation 1, $\lambda_n$ represents a heating time s, $a_n$ represents a heating furnace heat loss correction coefficient, $T_n$ represents a heating temperature ° C., $b_n$ represents an Ac3 temperature correction coefficient, $c_n$ represents a high temperature material thickness sensitivity correction coefficient, and t represents a material thickness mm. In this case, the material may denote a blank, and the unit s of the heating time may denote seconds.

Because different heat sources are used for each heating furnace type, heat loss generated by each heating furnace type may also be different. $a_n$ is a correction factor considering the heat loss of the heating furnace, and may have a value of about −0.60 or greater and about −0.55 or less. In this case, an may have a unit of s/(° C.×mm).

When the components of each material are different, the temperature at which the phase transformation occurs may be different. $b_n$ is a correction coefficient in consideration of an Ac3 temperature difference according to a material component, and may have a value of about 700 or greater and about 900 or less. In this case, $b_n$ may have a unit of s/mm.

The thermal conductivity (or heat transfer amount) transferred inside the material may vary depending on the thickness of the material. $c_n$ is a correction coefficient in consideration of a difference in thermal conductivity (or heat transfer amount) depending on the thickness of the material at high temperature, and may have a value of about 0.7 or greater and about 0.9 or less. In this case, the high temperature may denote 600° C. or higher. However, high temperature may denote 500° C. or higher, or 700° C. or higher.

The heating temperature In denotes the soaking temperature of the soaking S220, and the heating temperature $T_n$ may have a value of about Ac3 or higher and about 1000° C. or less. In addition, the material thickness t may have a value of about 1 mm or greater and about 2.6 mm or less.

In an exemplary embodiment, the heating time $\lambda_n$ according to Equation 1 may be about 100 s or more and about 900 s or less. When the heating time In is less than 100 s, sufficient phase transformation may not be achieved in the blank. On the other hand, when the heating time $\lambda_n$ is more than 900 s, austenite grain coarsening and hydrogen resistance may occur, as well as the thickness of the plating layer may be increased to deteriorate weldability. Therefore, when the heating time $\lambda_n$ satisfies the range of about 100 s or more and about 900 s or less, sufficient phase transformation may be achieved in the blank, the occurrence of austenite grain coarsening may be prevented or minimized, and hydrogen embrittlement resistance and/or deterioration of weldability may be prevented or minimized.

Figure 6:
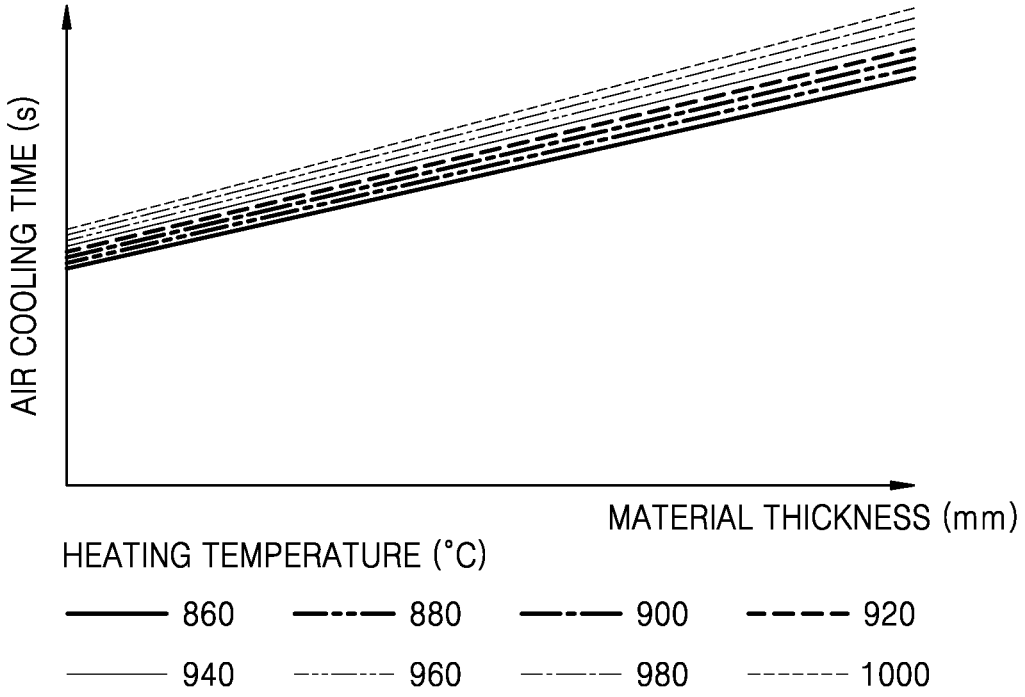
FIG. 6 shows a graph showing an air cooling time according to a material thickness and an air cooling time according to a heating temperature.

FIG. 6 shows a graph showing an air cooling time according to a material thickness and an air cooling time according to a heating temperature. Specifically, FIG. 6 is a graph illustrating a maximum allowable air cooling time according to a material thickness and the maximum allowable air cooling time according to a heating temperature. The high heating temperature in FIG. 6 may be understood as a high heating furnace discharge temperature.

Referring to FIGS. 1, 2, and 6, it may be seen that the maximum allowable air cooling time increases as the heating temperature decreases at the same material thickness. In addition, it may be seen that the maximum allowable air cooling time increases as the thickness of the material increases at the same heating temperature.

When the heated blank is excessively exposed to room temperature, not only productivity is lowered, but also phase transformation occurs in the blank during air cooling, thereby reducing formability and making it difficult to secure a target material. On the other hand, when the exposure time of the heated blank to room temperature is short, molding may be initiated at an excessively high temperature, and wrinkles (or flexures) may occur in the manufactured hot stamping component. In addition, a plating layer of the blank may be sintered in the mold. Therefore, it is necessary to adjust the air cooling time in the transferring (S300). However, in order to control the air cooling time in the transferring (S300), it is required to consider not only the heating temperature and the thickness of the blank (e.g., the thickness of the material), but also various variables such as the thermal conductivity according to the blank composition, the thickness of the blank, the coating amount, and surface emissivity, the heat conduction rate and the heat transfer amount, and the heating furnace discharge temperature of the blank and the ambient temperature.

Accordingly, the present inventors derived Equation 2 capable of easily controlling the air cooling time through sufficiently repeated experiments. In an exemplary embodiment, the air cooling time of the blank in the transfer (S300) may satisfy Equation 2 below.

$$\lambda_t=(a_t\times T_t+b_t)\times t^{c_t} \quad \text{<Equation 2>}$$

In Equation 2, $\lambda_t$ represents an air cooling time s, $a_t$ represents a heating furnace discharge temperature and atmospheric temperature correction coefficient, $T_n$ represents a heating temperature ° C., $b_t$ represents a material component correction coefficient, $c_n$ represents a high temperature material thickness sensitivity correction coefficient, and t represents a material thickness mm. In this case, the material may denote a blank, and the unit s of the air cooling time may denote seconds.

$a_t$ is a correction coefficient in consideration of a heating furnace discharge temperature and an atmospheric temperature of a heated blank, and may have a value of about 0.0160 or greater and about 0.0165 or less. In this case, $a_t$ may have a unit of s/(° C.×mm).

$b_t$ is a correction coefficient considering the case when each material has different components, and may have a value of about −10.0 or greater and about 0.5 or less. In this case, $b_t$ may have a unit of s/mm.

In addition, the amount of heat transferred inside the material may vary depending on the thickness of the material. $c_t$ is a correction coefficient considering a difference in heat transfer amount depending on the thickness of the material at high temperature, and may have a value of about 0.7 or greater and about 0.9 or less. In this case, the high temperature may denote 600° C. or higher. However, high temperature may denote 500° C. or higher, or 700° C. or higher.

The heating temperature $T_t$ denotes a soaking temperature of the soaking (S220), and the heating temperature $T_t$ may have a value of about Ac3 or higher and about 1000° C. or less. At this time, the heating temperature $T_t$ may denote a heating furnace discharge temperature. In addition, the material thickness t may have a value of about 1 mm or greater and about 2.6 mm or less.

In an exemplary embodiment, the air cooling time $\lambda_t$ according to Equation 2 may be about 5 s or more and about 20 s or less. When the air cooling time $\lambda_t$ is less than 5 s, the molding start temperature at which the blank molding starts is too high, thus, the blank molding proceeds at a high temperature, and wrinkles (or bends) may occur in the manufactured hot stamping component, and it may be difficult to implement an air cooling time $\lambda_t$ of less than 5 s on a facility-wise. On the other hand, when the air cooling time $\lambda_t$ is more than 20 s, not only productivity is lowered, but also phase transformation occurs in the blank in the process of transferring the blank, thereby reducing the formability of the blank, and the manufactured hot stamping component may not have a target material. Therefore, when the air cooling time $\lambda_t$ satisfies the range of about 5 s or more and about 20 s or less, the formability of the blank and productivity of the process may be improved, and the manufactured hot stamping component may have a target material.

Figure 7:
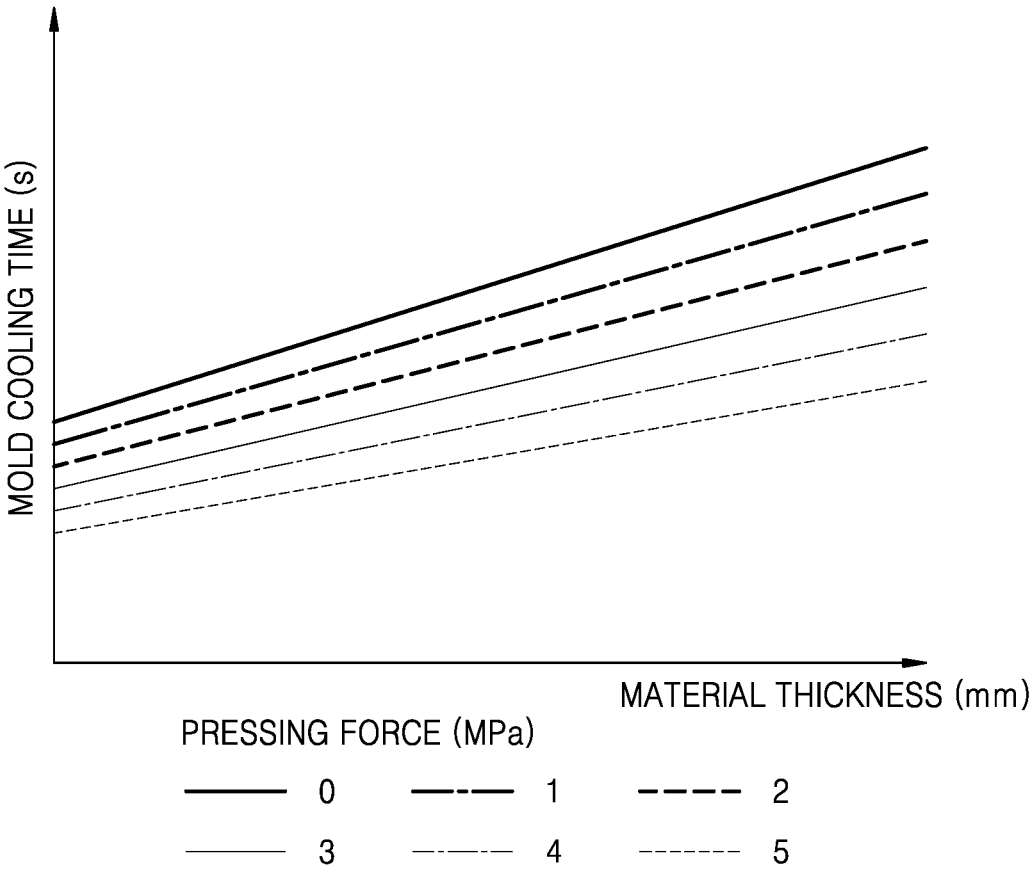
FIG. 7 shows a graph illustrating a mold cooling time according to a material thickness and a mold cooling time according to a pressing force.

FIG. 7 shows a graph illustrating a mold cooling time according to a material thickness and a mold cooling time according to a pressing force. Specifically, FIG. 7 is a graph illustrating the minimum allowable mold cooling time according to a material thickness and the minimum allowable mold cooling time according to a pressing force.

Referring to FIGS. 1, 2, and 7, when the material thickness is the same, it may be seen that the minimum allowable mold cooling time decreases as the pressing force increases. In addition, when the pressing force is the same, it may be seen that the minimum allowable mold cooling time increases as the thickness of the material increases.

If the mold cooling time for cooling the molded body molded in the cooling (S500) is short, the mold cooling is terminated at an excessively high temperature, and then, the manufactured hot stamping component is air-cooled at room temperature for a long time, which may cause distortion of the manufactured hot stamping component, and thus, obtaining a target dimension may be difficult. On the other hand, if the mold cooling time for cooling the molded body formed in the cooling (S500) is long, productivity may be reduced. Therefore, it is necessary to adjust the mold cooling time in the cooling (S500). However, in order to control the cooling time in the cooling (S500), various variables should be considered, such as not only the pressing force of the mold and the thickness of the blank (e.g., the thickness of the material), but also the thermal conductivity of the mold, the cooling behavior according to the components of the blank, hardenability according to the blank component.

Accordingly, the present inventors derived through sufficiently repeated experiments Equation 3 that may be used to easily control the mold cooling time. In an exemplary embodiment, the mold cooling time of the molded body in the cooling (S500) may satisfy Equation 3 below.

$$\lambda_q=(a_q\times P+b_q)\times t^{c_q} \quad \text{<Equation 3>}$$

In Equation 3, $\lambda_q$ represents a mold cooling time s, $a_q$ represents a mold correction factor, P represents a pressing force MPa, $b_q$ represents a material hardenability correction coefficient, $c_q$ represents a low temperature material thickness sensitivity correction coefficient, and t represents a material thickness mm. In this case, the material may denote a blank, and the unit s of the mold cooling time may denote seconds.

The thermal conductivity may be different depending on the material of a mold. In addition, the local thermal conductivity generated within the same component may be different according to a difference in deformation amount for each molding position (flat part, edge part, side wall part, etc.). $a_q$ is a correction factor considering the thermal conductivity of the mold and the local thermal conductivity occurring in the component, and may have a value of about −1.0 or greater and about −0.2 or less. In this case, $a_q$ may have a unit of s/(MPa×mm).

When the components of each material are different, a continuous cooling transformation (CCT) curve of a molded body including the components may be different, and the martensitic transformation initiation temperature may be different. $b_q$ is a correction factor in consideration of a continuous cooling transformation (CCT) curve and/or a martensitic transformation initiation temperature of a molded body according to a material component, and may have a value of about 11 or greater and about 15 or less. In this case, $b_q$ may have a unit of s/mm.

An amount of heat transferred inside the material may vary depending on a thickness of the material. $C_q$ is a correction factor considering a difference in heat transfer amount depending on the thickness of the material at low temperature, and may have a value of about 1.00 or greater and about 1.05 or less. In this case, the low temperature may denote 600° C. or less. However, the low temperature may denote 500° C. or less or 700° C. or less.

The pressing force P may be a minimum pressing force in the mold cooling process. Specifically, the pressing force P may be a minimum value among the pressing forces applied for each part of the blank (e.g., flat part, edge part, side wall part, etc.), and may be a pressing force at a part where the force of the mold does not act vertically (e.g., side wall part). For example, the pressing force P may have a value of about 0.1 MPa or greater. In an actual process, the pressing force P may be about 5 MPa or greater. However, even when the pressing force P is 5 MPa or greater, the pressing force P in Equation 3 may have a value of 5 MPa in order to easily derive the mold cooling time $\lambda_q$.

In addition, the material thickness t may have a value of about 1 mm or greater and about 2.6 mm or less.

In an exemplary embodiment, the mold cooling time $\lambda_q$ according to Equation 3 may be about 6 s or more and about 40 s or less. If the mold cooling time $\lambda_q$ is less than 6 s, the mold cooling may be terminated at a high temperature and may be accompanied by long air cooling, which may cause distortion in the manufactured hot stamping component, and a target dimension may not be secured. On the other hand, when the mold cooling time $\lambda_q$ exceeds 40 s, productivity may decrease. Therefore, if the mold cooling time $\lambda_q$ satisfies the range of about 6 s or more and about 40 s or less, when the temperature of the blank is about room temperature or higher and about 200° C. or less, the mold cooling is terminated, the occurrence of distortion in the manufactured hot stamping component may be prevented or minimized, and the productivity of the manufacturing process may be improved.

Figure 8:
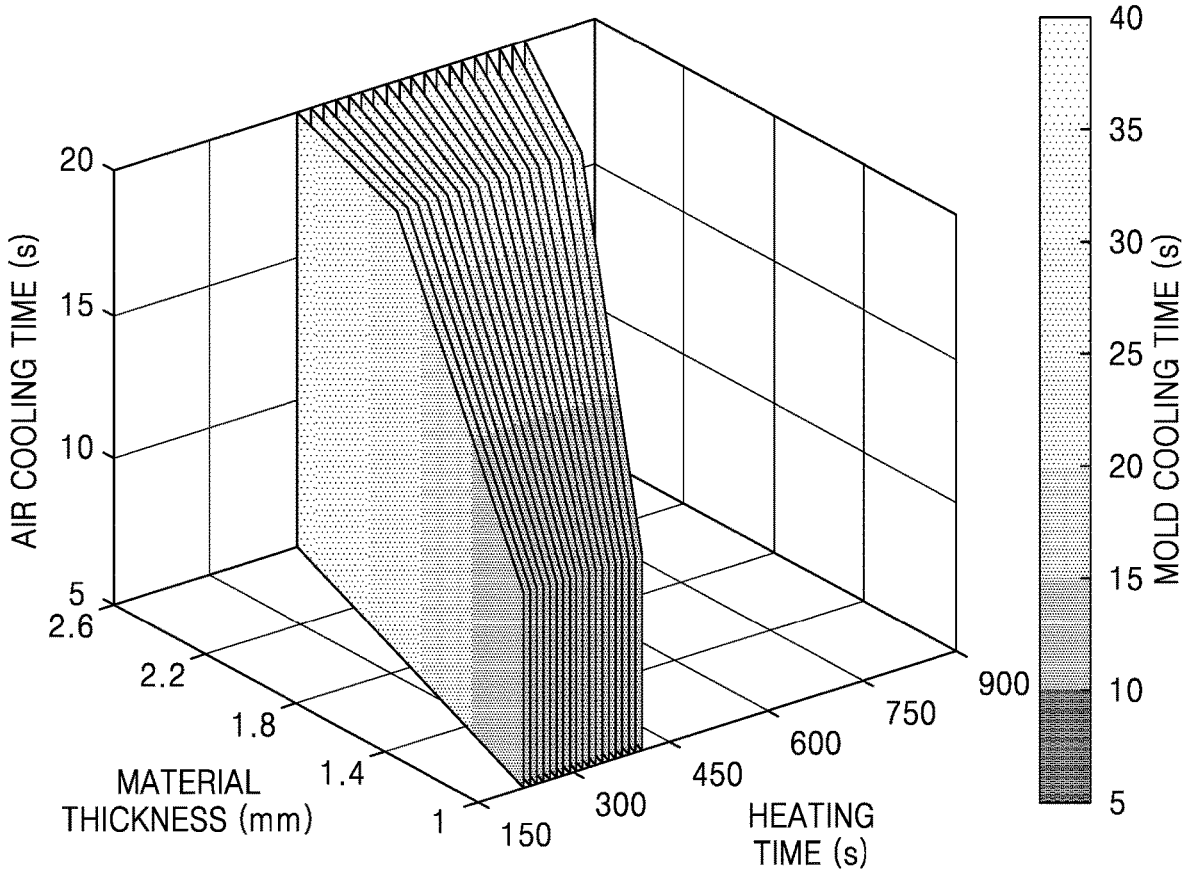
FIG. 8 shows a diagram illustrating a process window derived using a material thickness, a heating time, an air cooling time, and a mold cooling time as parameters.

FIG. 8 shows a diagram illustrating a process window derived using a material thickness, a heating time, an air cooling time, and a mold cooling time as parameters. The process window of FIG. 8 is a graph derived using a material thickness, a heating time, an air cooling time, and a mold cooling time as parameters.

Referring to FIGS. 1 and 8, the method of manufacturing a hot stamping component may include operations of inserting a blank (S100), heating (S200), transferring (S300), forming (S400), and cooling (S500).

In an exemplary embodiment, a heating time in the heating (S200) may be easily derived using Equation 1 above, an air cooling time in the transferring (S300) may be easily derived using Equation 2 above, and a mold cooling time in the cooling S500 may be easily derived using Equation 3 described above. In addition, a process window may be derived using the heating time, air cooling time, mold cooling time, and material thickness derived through Equation 1, Equation 2 and Equation 3, respectively, as parameters. That is, a process window may be derived using the heating time in the heating S200, the air cooling time in the transferring S300, the mold cooling time in the cooling S500 and the material thickness as parameters. At this time, in the process window, the material thickness may be about 1.0 mm or greater and about 2.6 mm or less, the heating time may be about 100 s or more and about 900 s or less, the air cooling time may be about 5 s or more and about 20 s or less, and the mold cooling time may be about 6 s or more and about 40 s or less.

In an exemplary embodiment, by deriving an integrated parameter window for the heating (S200), the transferring (S300) and the cooling (S500) using the material thickness, heating time, air cooling time, and mold cooling time as parameters, it is possible to induce a flexible process design before a hot stamping process, improve the quality of the manufactured hot stamping component, and make it easier to control the quality of the manufactured hot stamping component.

In an exemplary embodiment, the hot stamping component manufactured through an embodiment of the present disclosure may have a tensile strength of about 1350 MPa or greater and less than about 2300 MPa. The manufactured hot stamped component may have a tensile strength of greater than or equal to about 1350 MPa and less than about 1680 MPa. Alternatively, the manufactured hot stamping component may have a tensile strength of about 1680 MPa or greater and less than about 2300 MPa.

Although the present disclosure has been described with reference to the embodiment shown in the drawings, which is merely an example, it will be understood by those of ordinary skill in the art that various changes in form and details may be made therein without departing from the spirit and scope of the inventive concept. Accordingly, the scope of the invention is defined not by the detailed description of the invention but by the appended claims.

The invention claimed is:

1. A method of manufacturing a hot stamping component, the method comprising:

inserting a blank into a heating furnace;

heating the blank; and transferring the heated blank from the heating furnace to a mold;

wherein an air cooling time of the blank in the transferring of the blank satisfies Equation 1 below $$\lambda_t=(a_t\times T_t+b_t)\times t^{c_t} \quad \text{<Equation 1>}$$

where $\lambda_t$ represents an air cooling time(s), $a_t$ represents a heating furnace discharge temperature and an atmospheric temperature correction coefficient, $T_t$ represents a heating temperature (° C.), $b_t$ represents a material component correction coefficient, t represents a material thickness (mm), and $c_t$ represents a high temperature material thickness sensitivity correction coefficient.

2. The method of claim 1, wherein, in Equation 1, at is 0.0160 or greater and 0.0165 or less, $T_t$ is Ac3 or more and 1000° C. or less, $b_t$ is −10 or greater and 0.5 or less, t is 1 mm or greater and 2.6 mm or less, and $c_t$ is 0.7 or greater and 0.9 or less.

3. The method of claim 2, wherein, in Equation 1, $\lambda_t$ is 5 s or more and 20 s or less.

4. The method of claim 3, wherein, in the transferring of the blank, the heated blank is air-cooled at room temperature.

5. The method of claim 1, wherein the heating of the blank comprises:

step-heating the blank in multiple stages; and soaking the blank in a temperature range of about Ac3 to about 1,000° C.

6. The method of claim 5, wherein, in the heating of the blank, the heating time of the blank satisfies equation (2) below $$\lambda_n=(a_n\times T_n+b_n)\times t^{c_n} \quad \text{<Equation 2>}$$

where $\lambda_n$ represents a heating time(s), $a_n$ represents a heating furnace heat loss correction coefficient, $T_n$ represents a heating temperature (° C.), $b_n$ represents an Ac3 temperature correction coefficient, t represents a material thickness (mm), and $c_n$ represents a high temperature material thickness sensitivity coefficient.

7. The method of claim 6, wherein, in Equation 2, an is −0.60 or greater and −0.55 or less, $T_n$ is Ac3 or greater and 1000° C. or less, $b_n$ is 700 or greater and 900 or less, t is 1 mm or greater and 2.6 mm or less, and $c_n$ is 0.7 or greater and 0.9 or less.

8. The method of claim 7, wherein, in Equation 2, $\lambda_n$ is 100 s or more and 900 s or less.

9. The method of claim 5, wherein the heating furnace comprises a plurality of sections having different temperature ranges.

10. The method of claim 9, wherein a ratio of a length of sections for step-heating the blank to a length of a section for soaking the blank is about 1:1 to 4:1.

11. The method of claim 1, further comprising:

after transferring the blank, forming a molded body by pressing the transferred blank with the mold; and cooling the formed molded body.

12. The method of claim 11, wherein, in the molding of the molded body, a molding start temperature of the blank is 500° C. or higher and 700° C. or less.

13. The method of claim 11, wherein the cooling of the molded body is performed within the mold.

14. The method of claim 13, wherein, in the cooling of the molded body, a mold cooling time during which the molded body is cooled in the mold satisfies Equation 3 below $$\lambda_q=(a_q\times P+b_q)\times t^{c_q} \quad \text{<Equation 3>}$$

where $\lambda_q$ represents a mold cooling time(s), $a_q$ represents a mold thermal conductivity correction coefficient, P represents a pressing force (MPa), $b_q$ represents a material hardenability correction coefficient, t represents a material thickness (mm), and $c_q$ represents a low temperature material thickness sensitivity coefficient.

15. The method of claim 14, wherein, in Equation 3, $a_q$ is −1.0 or greater and −0.2 or less, P is 0.1 MPa or greater and 5 MPa or less, $b_q$ is 11 or greater and 15 or less, t is 1 mm or greater and 2.6 mm or less, and $c_q$ is 1.00 or greater and 1.05 or less.

16. The method of claim 15, wherein, in Equation 3, $\lambda_q$ is 6 s or more and 40 s or less.

17. The method of claim 11, wherein, in the cooling of the molded body, a cooling end temperature of the mold at which the cooling is terminated is above the room temperature and below about 200° C.

18. A hot stamping component manufactured according to the method of claim 1, the hot stamping component having a tensile strength of 1,350 MPa or greater and less than 2,300 MPa.

* * * * *